United States Patent [19]

Gazda et al.

[11] Patent Number: 4,855,029

[45] Date of Patent: Aug. 8, 1989

[54] INTEGRAL CATHODIC PROTECTION DEVICE

[75] Inventors: Chester T. Gazda, Chicopee; Lawrence F. O'Melia, Easthampton, both of Mass.

[73] Assignee: Titeflex Corporation, Springfield, Mass.

[21] Appl. No.: 96,515

[22] Filed: Sep. 11, 1987

[51] Int. Cl.[4] ..... C23F 13/00

[52] U.S. Cl. ..... 204/197; 204/286

[58] Field of Search ..... 204/147, 148, 196, 197, 204/286, 297 R

[56] References Cited

U.S. PATENT DOCUMENTS

| | | | |
|---|---|---|---|
| 685,176 | 10/1901 | Ross | 204/197 |
| 2,343,440 | 3/1944 | Andrus | 204/197 |
| 2,887,446 | 5/1959 | Marx | 204/197 |
| 3,108,055 | 10/1963 | Grant | 204/196 |
| 3,202,596 | 8/1965 | Canevari | 204/197 |
| 3,484,350 | 12/1969 | Zaremski | 204/148 |
| 3,594,706 | 7/1971 | Sotolongo | 339/114 |
| 3,623,968 | 11/1971 | Bohne | 204/197 |
| 3,629,092 | 12/1971 | George | 204/197 |
| 3,739,456 | 6/1973 | Scherer et al. | 204/197 |
| 3,891,530 | 6/1975 | Alewitz | 204/197 |
| 4,045,320 | 8/1977 | Klingenberg | 204/197 |
| 4,146,448 | 3/1979 | Nakano et al. | 204/197 |
| 4,176,033 | 11/1979 | Council | 204/197 |
| 4,195,197 | 3/1980 | Kurr et al. | 204/197 |
| 4,370,211 | 1/1983 | Hybler | 204/148 |
| 4,496,013 | 1/1985 | Serpa | 175/374 |
| 4,496,444 | 1/1985 | Bagnulo | 204/148 |
| 4,502,929 | 3/1985 | Stewart et al. | 204/291 |
| 4,688,828 | 8/1987 | Shaffer | 204/197 |
| 4,692,231 | 9/1987 | St. Onge | 204/197 |

*Primary Examiner*—T. Tung

*Attorney, Agent, or Firm*—Louis Bernat

[57] ABSTRACT

A sacrificial anode is made in the form of a disk with a tire made of a sacrificial anodic material. The disk has a central hole which fits over one of two parts to hold the disk in place, as between two telescoping parts, for example. A number of alternative modes of sacrificial anode construction are shown. In some embodiments, conductive or semiconductive plastics are used to provide connections with controlled conductivity.

10 Claims, 4 Drawing Sheets

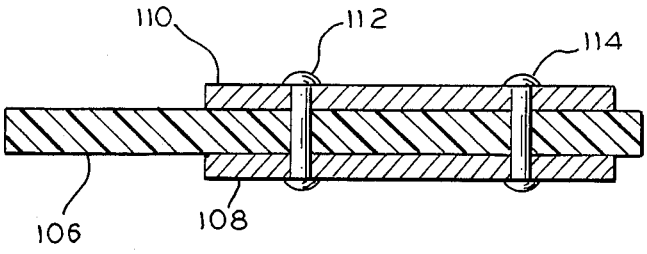
FIG.11
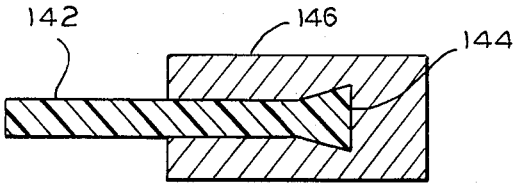
FIG.14
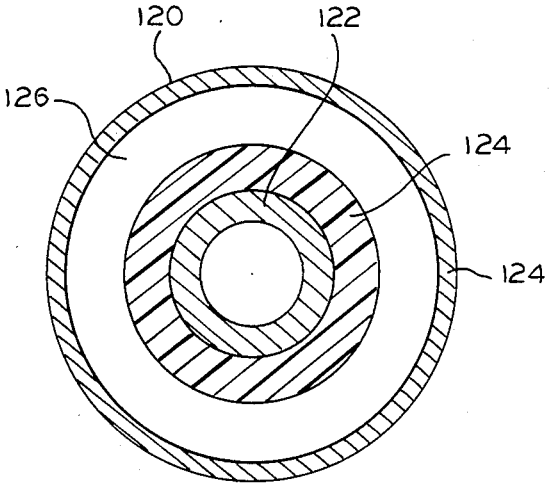
FIG.12
FIG.13
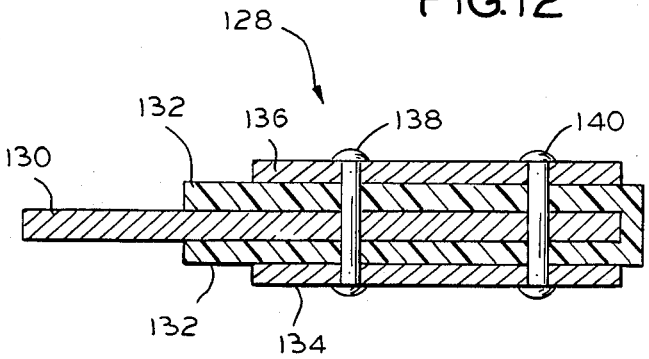
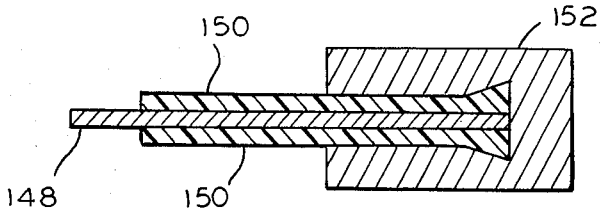
FIG.15

INTEGRAL CATHODIC PROTECTION DEVICE

This invention relates to cathodic protection devices and, more particularly, to cathodic protection devices for conduits, end fittings, and the like, which may be built into machines at the time of their manufacture.

All materials have an inherent electrical charge or potential which results from their atomic and molecular structures. Thus, if dissimilar materials are sufficiently close to each other when in the presence of a suitable electrolyte, such as earth water found in the soil or marine environment, there are galvanic currents from materials having charges of higher potential to materials having charges of lower potential. Since these galvanic currents transport minute amounts of material, one of the materials eventually disintegrates. The first observable phenomena of such disintegration are rust, corrosion and the like.

Usually, the metallic state (which is a high energy form) is uncommon in nature where most metals are found as oxides or compounds of oxides (which are a low energy form). These oxides achieve the higher state of internal energy during a refining process which ultimately leads to the production of a useful metal. Corrosion is the process by which the metal returns from this unnaturally higher level of energy to the original lower energy level of the oxide state.

Corrosion of metals occurs if some of the metallic molecules, immersed in an electrolyte, disassociate themselves from the metals and into ions. However, the conditions under which corrosion occur are poorly defined. Thus the theory of corrosion is more helpful in explaining why a corrosion has already taken place rather than in predicting what is to be expected.

For instance, when iron and copper are immersed in a common electrolyte, such as ground water, iron molecules have a greater tendency than copper molecules to lose their electrons, to become positive ions, and to disassociate themselves from the metal. When this occurs, the iron becomes negatively charged with respect to the electrolyte or liquid in which it is immersed. Therefore, a galvanic couple is formed between the iron and copper. The resulting imbalance of electrons causes a current to flow from the iron to the copper. As the electrons are deposited at the copper, a chemical reaction occurs in the iron to form an oxide. From this, it is clear that if iron and copper, for example are immersed in a common electrolyte, the oxidization of the iron is greatly accelerated.

The traditional approaches to a reduction of such a disintegration is to provide cathodic protection. This may be done in a number of different ways, as by plating a base metal with another metal having a higher molecular charge. For example, the zinc coating on galvanized iron acts as an anode and thus protects the underlying iron. The zinc is a "sacrificial anode" which is eventually destroyed to protect the iron. As the zinc is transported away by the galvanic currents, the iron is uncovered and rust begins.

To overcome these problems, another and separate metal bulk (sometimes called a "sacrificial anode") is often immersed in the electrolyte to attract galvanic currents which would otherwise flow to the metal to be protected. The anode metal is selected from a class of metals having a higher anodic voltage potential relative to the protected material, such as steel. Then, the other and separate anode metal bulk gives up its electrons, is broken down, and sacrificed to absorb corrosive potentials, thus diverting these potentials from the galvanic couple formed by copper and steel, for example. Therefore, fundamentally cathodic protection involves the impressing of an electromotive force which makes the structure cathodic with respect to the adjacent soil.

The term "sacrificial with respect to" any given protected material means that the anode metal is higher in the galvanic series than the protected material. By way of example, one galvanic series is as follows:

| Material: | Approximate potentials with respect to saturated copper-copper sulfate electrode, volts* |
|---|---|
| Commercially pure magnesium | −1.75. |
| Magnesium alloy (6 percent Al, 3 percent Sn, 0.15 percent Mn) | −1.6. |
| Zinc | −1.1. |
| Aluminum alloy (5 percent Zn) | −1.0. |
| Commercially pure aluminum | −0.8. |
| Cadmium | −0.8. |
| Mild steel (clean and shiny) | −0.5–0.8. |
| Mild steel (rusted) | −0.2–0.5. |
| Cast iron (not galvanized) | −0.5. |
| Lead | −0.5. |
| Tin | −0.5. |
| Stainless steel, Type 304 (active state) | −0.5. |
| Copper, brass, bronze | −0.2. |
| Mild steel (in concrete) | −0.2. |
| Titanium | −0.2. |
| High silicon cast iron | −0.2. |
| Nickel | +0.1 to −0.25. |
| Monel | −0.15. |
| Silver solder (40 percent) | −0.1. |
| Stainless steel, Type 304 (passive state) | +0.1. |
| Carbon, graphite, coke | +0.3. |

*These values are representative of the potentials normally observed in soils and waters which are neither markedly acid nor markedly alkaline.

Of the metals listed in this particular table, magnesium, zinc, aluminum and cadmium, for example, are sacrificial with respect to steel.

Thus, if one of these sacrificial anodes is a slight stand-off distance away from the protected material, the disintegrating current extends to it and not to the protected material. Then, the disintegration occurs at the anode and not at the protected material. By having the anode in a standoff or remote position relative to the material which it is protecting, instead of directly affixed to it, and, in addition, by designing it so that a uniform geometric relationship exists, a condition is provided for the development of an equipotential galvanic voltage and a uniform current distribution. The presence of an equipotential voltage with uniform current distribution provides high efficiency of galvanic protection with uniform consumption of sacrificial material over designed life span.

The trouble with traditional stand-off approaches is that they usually require an installation and maintenance of a sacrificial anode in the field. Thus, a manufacturer who is guaranteeing its product must do so with faith that the user will perform the proper installation and maintenance. Since the user would very likely rely upon the guarantee in order to save the cost of maintenance, the manufacturer is very unlikely to guarantee its product for as long as it could guarantee it.

Accordingly, there is a need for a sacrificial anode which the manufacturer can build into a protected device, machine, or the like. Since the manufacturer can then control the proper installation of the anode, it can know that the anode will reliably function in an intended manner over a predictable lifetime. Hence, the manufacturer's guarantee may be extended to a major portion of a realistic life of a product.

An example of a manufactured part which is to be protected might be a hose, tube, or other conduit, for pumping a substance from a first location such as an underground fuel storage tank to a second location such as a filling station pump. For example, two general areas in an underground storage tank application where an underground flexible conduit may be used are a connection coming off a submersible pump at the top of the underground storage tank, and on the dispenser side, connection to an impact/shear valve. This connection comes off hard piping from a submersible pump or underground tank, and goes to a dispensing apparatus or fuel pump in a concrete island.

A typical length of these types of assemblies is in the order of 24" to 30"; however, there are also applications for shorter or longer lengths. All of these products may have the same common denominator in that they are buried underground (submersible pump lines, dispenser lines) or otherwise are located in an electrolyte where cathodic protection is required.

The Environmental Protection Agency (EPA) has mandated a use of flexible connectors with non-metallic piping, and further has mandated that any metallic component which is buried underground shall be cathodically protected. The EPA has also specified various swivel or swing joints or pipes in order for them to give if freezing, thawing, etc. apply rotational forces or similar stresses. If these joints are to function properly, they must not corrode or rust, and, therefore, must be cathodically protected. The environment at the opposite ends of the hose is not fully predictable and may not always be the same. Another problem is that the sacrificial anode may not be installed correctly on site. Cables or conductors associated with the anodes may not be connected properly.

Accordingly, an object of the invention is to provide new and improved sacrificial anodes, especially for underground conduits. Here, an object is to provide such an anode which may be installed by the manufacturer. Thus, an object is to enable a sacrificial anode to be installed directly in a manufactured part.

Another object of the invention is to provide sacrificial anodes for hoses, tubes, conduits, pipes, swinging or swivel joints, and the like. Here, an object is to protect fuel delivery systems.

In keeping with an aspect of the invention, these and other objects are accomplished by providing a disk- or wheel-like structure which may be fitted over the end of a hose, around a fitting, or the like. A tire of sacrificial anode material is located at the perimeter of the disk to provide a bulk of a sacrificial anode, which is thus positioned to stand off from the protected hose or end fitting. In some embodiments, a conductive plastic is added to the disk or near the sacrificial anode in order to control the galvanic current.

Preferred embodiments of the invention are shown in the attached drawing, wherein:

FIGS. 4–18 show alternative examples of how to construct the anode itself.

Figure 1:
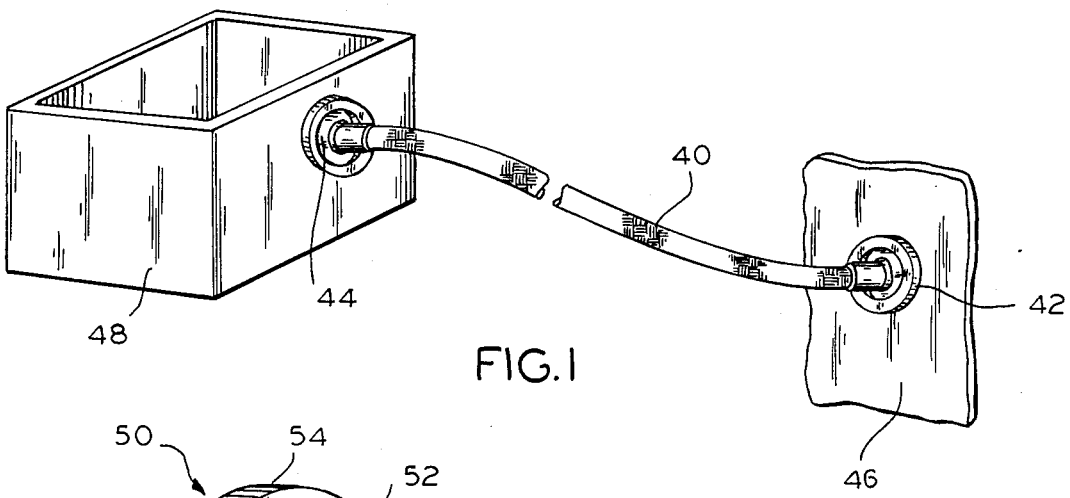
FIG. 1 illustrates a purely hypothetical installation which might be an example of a use of the invention.

The system of FIG. 1 is intended to be generic to any of many different systems where the invention may find use. Here, it is shown, by way of example, as being used on an underground hose or conduit 40 which is connected between two points 42, 44. In this particular example, conduit 40 is covered by steel braid. Parts 46, 48 may be any suitable devices. However, for convenience of explanation, it is assumed that point 42 is coupled to the wall 46 of a source of a fluid, such as an underground fuel tank, a water storage tank, or the like. Point 44 is at a remote location where limited amounts of fluid may be used. For example, tank 48 could represent a fuel delivery pump; or, it could be a place where animals drink water. Of course, these parts 46, 48 may also represent any means for conveying anything which may flow or otherwise be forced through the conduit 40.

This relatively simple system may be made of any number of different kinds of material which may form a galvanic couple. An electrolyte may be provided by ground water or another fluid which may cover the surfaces, such as dew, condensation, dampness, oils, or a film of dirt, grease, and grime which has accumulated over years of neglect. For whatever reason, the end fittings 42, 44, the braid, and perhaps the hose or conduit itself may be subject to galvanic currents with the resulting corrosion and disintegration.

Figure 2:
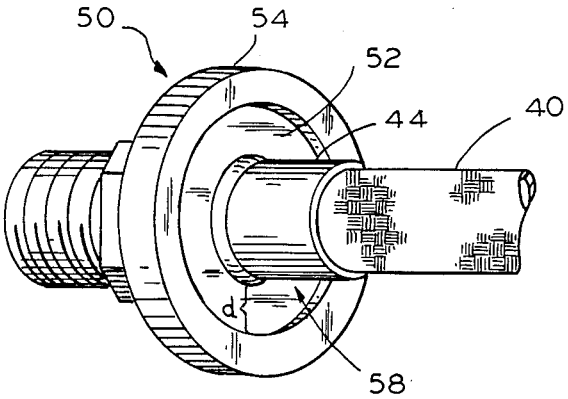
FIG. 2 is a perspective view of a sacrificial anode which might be used to protect an end fitting, for example, in the system of FIG. 1.

According to the invention (FIG. 2), a stand-off sacrificial anode structure 50 may be positioned on or around the hose or conduit 40. Preferably, the anode structure 50 has a disk-like body 52 with a rim or tire 54 made of a sacrificial anode material, with respect to the protected material at the fitting 44. Physically, the anode material 54 is close enough to the fitting 44 to attract the galvanic currents and yet far enough away from the fitting 44 to provide a controlled resistance path to the fitting material 44. For example, the path may be via iron or steel or via a conductive plastic.

A non-conductive insulator 55 (FIG. 3) may be provided at the end fitting in order to electrically isolate the fitting assembly from an associated piping system.

Figure 3:
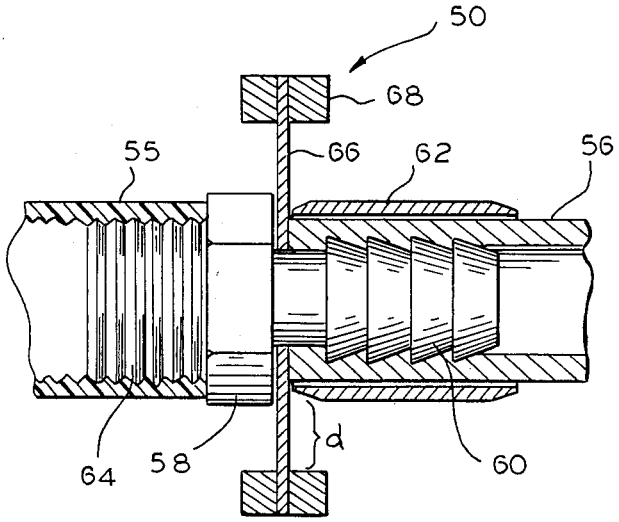
FIG. 3 shows one method of installing a sacrificial anode on a conduit.
Figure 4:
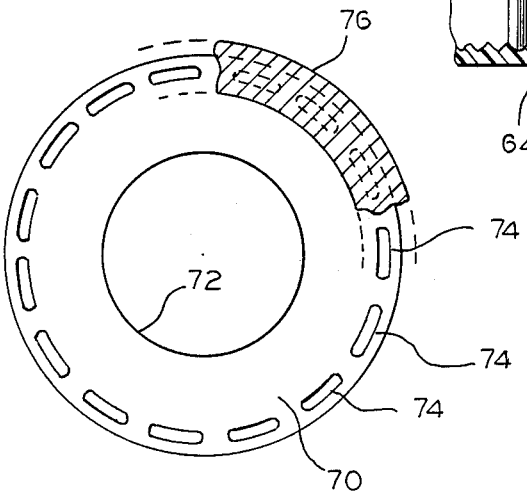
Figure 5:
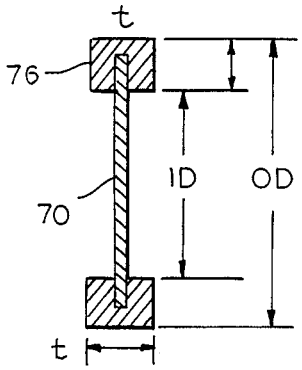

FIG. 3 illustrates a practical way of attaching the sacrificial anode structure 50 to almost any hose or conduit 56. Here, the hose 56 may be made of any suitable elastomer material, such as rubber, "Teflon", or the like. An end fitting 58 has a barbed end 60 which is easily pushed into and very difficult to pull from the end of the hose 56. Thus, the end 60 and hose 56 might be described as telescoping parts. A compression collar 62 may be clamped around the outside perimeter of the hose to firmly hold the barbed end 60 of the fitting 58 in place. The opposite end 64 of the end fitting may have any suitable connector, integrally formed thereon. For example, end 64 may be threaded in order to be turned into and connected to any suitable system. This disclosure of FIG. 3 is exemplary of many fairly conventional end fittings, which may differ in detail and have any of many forms, but which almost always have at least some parts which telescope together.

During manufacture of the FIG. 3 device, parts are telescoped together, as when the barbed end 60 is inserted into hose 56, for example. At this time, an inner one (here 60) of the telescoping parts is first fitted through a central hole in disk 66, before it enters into the outer part 56. Therefore, as the telescoping parts 60, 56 come together, the disk 66 is entrapped and secured in place. The addition of the compression collar 62 further locks the disk 66 firmly in place. While other end fittings may have different kinds of parts, those parts are usually assembled in a similar manner in order to secure the disk 66 in place.

The diameter of the disk 66 determines the stand-off distance d (FIGS. 2, 3) between the protected part 58 and the sacrificial anode. The outer periphery of disk 66 has a tire of anode material 68 firmly attached thereto, by any suitable means, such as swaging, riveting, crimping, bonding, or the like.

The anode design presented herein also offers anode attachments that, in addition to mechanical connections for electrical continuity, utilize metallurgical (i.e., welding), cast, interlock, and similar methods of joining materials for electrical continuity. These methods of providing electrical continuity are superior to only mechanical connections, per se, since they are not subject to corrosion processes which may cause an interruption in electrical continuity which occurs when connections loose as material reduction proceeds. As the anode erodes, there could be a development of a non-conductive corrosion by-product layer. Other similar modes of failure may occur when strictly mechanical fastening procedures using nuts, bolts, rivets, threads, etc., are used.

FIGS. 4–18 show alternative ways of constructing the sacrificial anode structure 50.

In a preferred embodiment (FIG. 4), a steel disk blank 70 is stamped from sheet metal, with a center hole 72 and a plurality of peripheral slots 74 formed therein. The diameters of hole 72 and disk 70 are selected according to both the diameter of a protected part and the stand-off distance required for the sacrificial anode to perform its function in any given condition. Then, the disk blank 70 is placed in a mold and a mass or tire of anode metal (zinc, for example) is cast around the entire rim of disk 70. The molten anode metal flows into the slots 74 to lock it into place. The dimensions of the sacrificial anode material 76 and the supporting disk 70 depend upon the needs of any given installation. However, by way of example, one anode device may be analyzed with the help of FIG. 5, as follows:

Surface area = Surface Area Top of Ring + Surface Area Bottom of Ring + Surface Area of *O.D.* Side + Surface Area of *I.D.* Side of Zinc Volume = Surface Area of Top of Ring × Thickness Mass = Volume × Specific Weight of Zinc Total Surface Area = 2 × Surface Area of Circular Ring + Surface Area *O.D.* Circumference + Surface Area of *I.D.* Circumference Surface Area Circular Ring = Surface of *O.D.* Circle − Surface area *I.D.* Circle = $\frac{\pi}{4} D^2_{(OD)} - \frac{\pi}{4} D^2_{(ID)}$ Surface Area *O.D.* Circumference = $\pi D_{OD} t$ Surface Area *I.D.* Circumference = $\pi D_{ID} t$ $$\text{Total Surface Area} = 2\frac{\pi}{4}(D^2_{OD} - D^2_{ID}) + \pi t (D_{OD} + D_{ID}) = \frac{\pi}{2}(D^2_{OD} - D^2_{ID}) + \pi t (D_{OD} + D_{ID})$$

Figure 6:
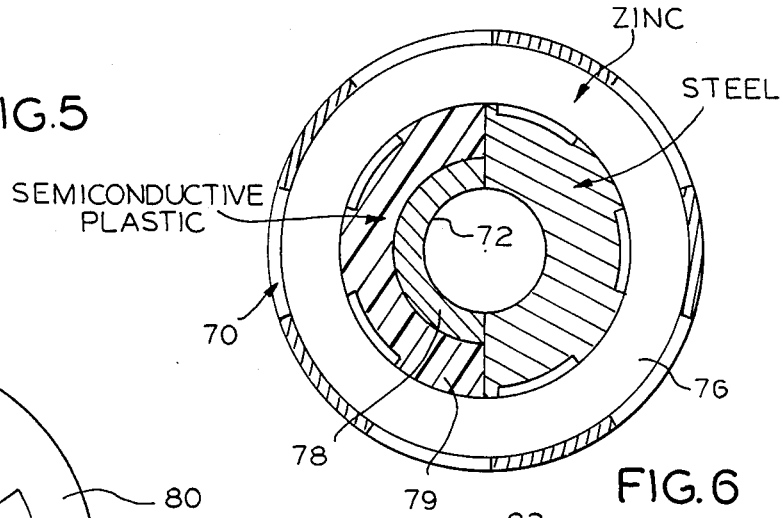

FIG. 6 shows a similar embodiment wherein the same parts have the same reference numerals. In this example, the hub area is a reinforced or wider steel collar 78. The face of the steel disk 70 is covered with a semiconductive plastic material 79 that provides a desirable amount of conductivity throughout the stand-off distance d.

Figure 7:
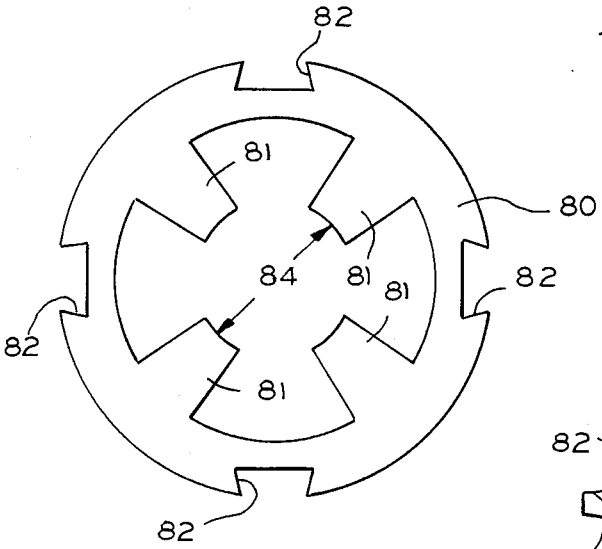
Figure 8:
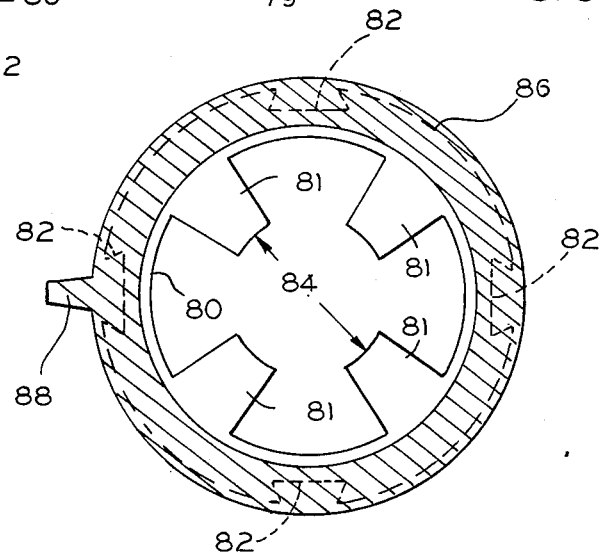

FIG. 7 shows an alternative design which involves a metal disk blank 80 which may be stamped with spokes 81 and with keystone-shaped locking slots or notches 82 on the outer perimeter. The diameter 84 of the space between the tip ends of the spokes 81 is determined by the outside diameter of the part over which the disk blank 80 is to be installed. After the disk blank 80 is stamped from sheet steel, it is galvanized. Then, it is placed in a mold where a zinc rim or tire 86 (FIG. 8) is cast over it, the molten zinc flowing into the keystone locking notches 82. This zinc forms the bulk of sacrificial anode material 86. The peg-like protrusion 88 provides an alternate method of increasing the anodic material weight and surface area while maintaining the desired anode diameter.

Figure 9:
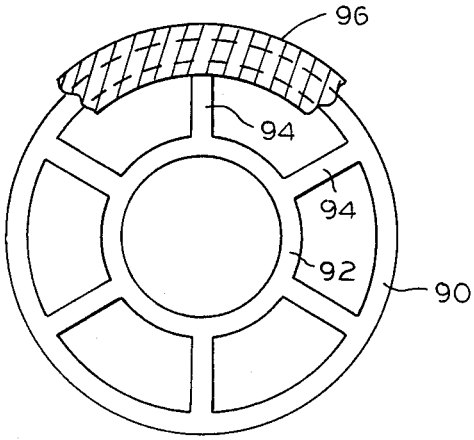

Still another form of disk is shown in FIG. 9 where the disk blank 90 has a central hub 92 with a plurality of spokes 94 radiating therefrom. Some thickness and rigidity may be added to the blank, by any suitable means such as embossing channels, bending flanges, or the like, on the spokes 94. Again, a tire of anode material 96 is cast around the circumference of the disk rim area.

Figure 10:
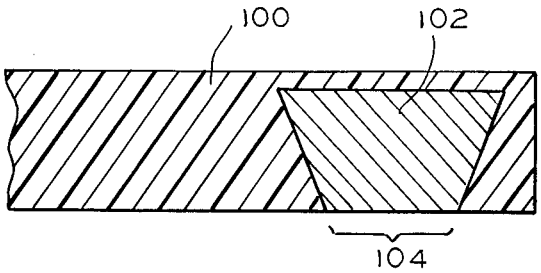

In FIG. 10, the disk blank 100 is made of a preferably molded conductive plastic. An annular ring area has a somewhat keystone-shaped cross section for receiving the zinc anode 102, which has a complementary keystone shape. The face 104 of the annular ring is exposed to the electrolyte through which the galvanic currents may flow. The method of manufacture depends upon the relative melting temperatures of the plastic and anode. The material with the higher melting temperature is cast first. Then, the material with the lower melting temperature is cast over or into the first casting.

In FIG. 11, the disk 106 is made of a conductive plastic. Two annular anode plates 108, 110 are fastened adjacent the perimeter of the disk 106 by a plurality of any suitable fasteners, here rivets 112, 114. The fasteners could also be any other suitable device, such as nuts and bolts, wire spring clips, or the like. However, the fasteners should have a design which will not fail to hold the anode material 108, 110 as it disintegrates under the attack of the galvanic currents, throughout the years of its lifetime.

FIG. 12 shows a composite disk 120 having a steel hub area 122 with a conductive plastic disk 124 secured thereto. An annular zinc anode 126 is attached to at least one and preferably two sides of the conductive plastic plate 124.

In FIG. 13, the composite disk 128 has a steel center disk blank 130, with a conductive plastic cladding 132 surrounding and encasing it in the outer perimeter part. A pair of sacrificial anodes 134, 136 are attached to the composite disk 128 by any suitable means such as rivets 138, 140. These anodes may be annular; or, they may be segments added to the disk at selected locations. The conductive plastic cladding 132 may also extend over the entire surface of metal disk 130, in which case it may be applied by dipping.

In FIG. 14, the disk blank 142 is made entirely of a conductive plastic with a keystone-shaped area 144 at the periphery thereof. The zinc anode 146 surrounds the entire periphery of the disk 142 and locks onto the keystone shape 144.

The embodiment of FIG. 15 is similar to the embodiment of FIG. 14. However, a steel disk blank 148 is clad in conductive plastic 150 before the zinc anode 152 is added thereto.

Figure 16:
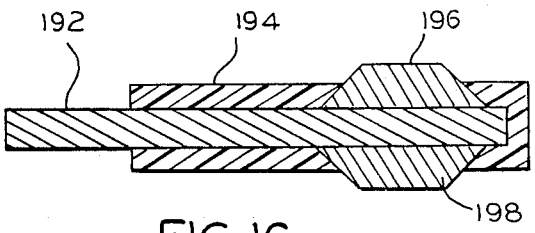

FIG. 16 has a steel disk 192 which is clad in semiconductor plastic 194, which completely surrounds and protects the periphery of the steel disk. Zinc anodes 196, 198 have a flared shape which is captured and held against the metal disk 192 by the conductive plastic flowing over it.

Figure 17:
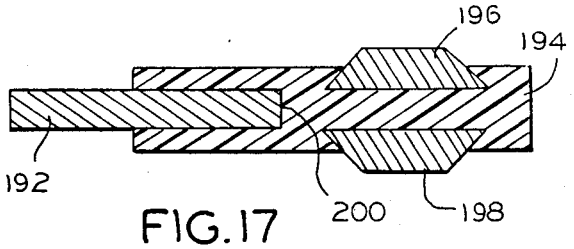
Figure 18:
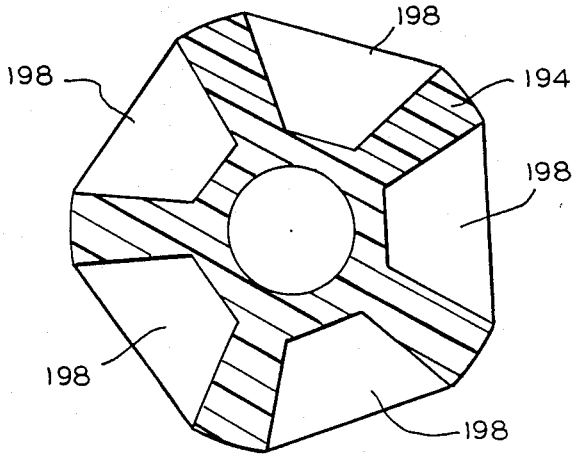

In FIG. 17, the steel disk 192 ends at 200 and the semiconductive plastic forms a cap over it. As in FIG. 16, the anodes 196, 198 are flared and captured by the semiconductive plastic. As shown in FIG. 18, the anodes 196, 198 may be a plurality of discrete elements which are distributed around the periphery of the disk.

A one-piece insert may be molded from both conductive and non-conductive plastics, with sacrificial anodic material encapsulated into the molding. The anodic material is exposed to the environment through the non-conductive plastic and makes electrical contact through the conductive plastic. This electrical contact is to the steel (or other metal) structure requiring cathodic protection.

A multi-piece insert or an insert with an outboard mounted sacrificial anode may be molded from both conductive and non-conductive plastics, also with encapsulated sacrificial anode material. Again, the anodic material is exposed to the environment through the non-conductive plastic while making electrical contact through the conductive plastic to the steel (or other metal) structure requiring cathodic protection. The two pieces may be joined by any practice which is commonly used for plastics, such as mechanical capture, adhesive bonding, melt fusion, and other practices.

These principles may be expanded to make virtually any combination which may be required for any given installation.

Those who are skilled in the art will readily perceive how modifications may be made in the invention. Therefore, the appended claims should be construed to cover all equivalents reasonably falling within the spirit and scope of the invention.

The invention claimed is:

1. A cathodic protection assembly, comprising:

a device having a cross-sectional portion with an outer periphery;

a stand-off comprising a semiconductive material surrounding the cross-sectional portion of the device to be protected and having an inner surface in electrical contact with the periphery of the device cross-sectional portion;

a continuous band of sacrificial anode material supported by said stand-off so as to continuously surround the cross-sectional portion of the device to be protected;

means for establishing electrical continuity throughout the band of sacrificial anode material and said stand-off; and said stand-off maintaining a preselected separation distance between said band of sacrificial anode material and the periphery of the cross-sectional portion of the device to be protected, and said stand-off continuously electrically connecting the band of sacrificial anode material to the periphery of the cross-sectional portion of the device to be protected to provide a controlled galvanic current path throughout the entire cross-sectional periphery of the device to be protected.

2. The assembly of claim 1 wherein said stand-off comprises a disk blank having a central hole receiving the cross-sectional portion of the device to be protected and having an outer rim whereat the band of sacrificial material is electrically connected, and wherein said disk blank has areas which are formed to enable anodic material to be fastened thereto.

3. The assembly of claim 2 wherein said areas are slots in said disk blank and said sacrificial anode material is molded onto the rim of said stand-off with said anodic material flowing into said slots while in a molten state.

4. The assembly of claim 2 wherein said sacrificial anode material is secured to said disk blank by rivets.

5. The assembly of claim 1 wherein said semiconductive material is a plastic.

6. The assembly of claim 1 wherein said device is an end fitting of a conduit.

7. A cathodic protection assembly for protecting an underground fluid delivery system comprising a conduit extending between two location, at least some of said conduit being exposed to underground water, said conduit having end fittings for making an attachment at each of said two locations, said assembly comprising a stand-off comprising a semiconductive material mounted on at least one of said end fittings so as to surround the cross-sectional portion of the end fitting and having an inner surface in electrical contact with the periphery of the end fitting;

a continuous band of sacrificial anode material supported by said stand-off so as to continuously surround the cross-sectional portion of the device to be protected;

means for establishing electrical continuity throughout the band of sacrificial anode material and said stand-off; and said stand-off maintaining a preselected separation distance between said band of sacrificial anode material and the periphery of said fitting, said stand-off continuously electrically connecting the band of sacrificial anode material to the periphery of the end fitting to provide a controlled galvanic current path throughout the periphery of the end fitting.

8. The assembly of claim 7 wherein said stand-off comprises a disk having a plurality of slots formed therein, and said band of sacrificial anode material is molded onto said disk with said sacrificial anode material flowing into said slots while in a molten state.

9. The assembly of claim 8 wherein said slots have a keystone shape.

10. The assembly of claim 8 wherein said disk has a central hole and said end fitting has at least two parts which telescope together, the inner one of said telescoping parts fitting through said central hole and the outer one of said telescoping parts capturing the disk by sliding into engagement therewith.

* * * * *